United States Patent [19]

Henthorne et al.

[11] 4,371,394

[45] Feb. 1, 1983

[54] CORROSION RESISTANT AUSTENITIC ALLOY

[75] Inventors: Michael Henthorne, Los Altos; Robert J. Yinger, Jamul, both of Calif.; Terry A. DeBold, Wyomissing, Pa.

[73] Assignee: Carpenter Technology Corporation, Reading, Pa.

[21] Appl. No.: 209,056

[22] Filed: Nov. 21, 1980

[51] Int. Cl.[3] ..... C22C 38/58

[52] U.S. Cl. ..... 75/128 A; 148/38

[58] Field of Search ..... 75/128 A; 148/38

[56] References Cited

U.S. PATENT DOCUMENTS

| | | | |
|---|---|---|---|
| 2,724,647 | 11/1955 | Fleischmann | 148/38 |
| 3,551,142 | 12/1970 | Decroix | 75/128 A |
| 3,726,668 | 4/1973 | Bäumel | 75/128 A |
| 3,825,417 | 7/1974 | Costello et al. | 75/128 A |
| 3,902,899 | 9/1975 | Sponseller | 75/128 A |
| 4,007,038 | 2/1977 | Deverell | 75/122 |
| 4,099,966 | 7/1978 | Chivinsky et al. | 75/128 A |
| 4,141,762 | 2/1979 | Yamaguchi et al. | 75/128 A |

OTHER PUBLICATIONS

Bäumel et al., "New Austenitic Stainless Steels", Proceedings of the 5th International Congress on Metallic Corrosion, NACE, 1974, pp. 934–941.

*Primary Examiner*—Peter K. Skiff
*Attorney, Agent, or Firm*—Edgar N. Jay

[57] ABSTRACT

A corrosion resistant austenitic stainless steel alloy and articles made therefrom consisting essentially in weight percent of

| | (w/o) |
|---|---|
| C | 0.03–0.1 |
| Mn | 4–11 |
| Si | 0.6 Max. |
| Cr | 20–23 |
| Ni | 14–18 |
| Mo | 4.8–5.6 |
| B | 0.01 Max. |
| Ce + La | 0.4 Max. |
| Al | 0.1 Max. |
| C + N | 0.23 Min. |

in which nitrogen ranges from a minimum of 0.15 w/o to no more than the amount that can be retained in solid solution, the balance being essentially iron, and the elements being balanced so that cold rolled annealed specimens prepared with a crevice and tested in accordance with ASTM G48-76 in 10 w/o $FeCl_3 \cdot 6H_2O$ at 50° C. for 72 hours have a weight loss of less than 0.3 gram. An embodiment that is particularly well suited for making autogeneously welded articles, e.g. tubing, for uses requiring exposure to brackish water consists essentially in weight percent of:

| | (w/o) |
|---|---|
| C | 0.06–0.08 |
| Mn | 4–6 |
| Si | 0.6 Max. |
| Cr | 20.5–21.5 |
| Ni | 14.5–15.5 |
| Mo | 4.8–5.4 |
| B | 0.0015–0.0035 |
| Al | 0.5 Max. |
| N | 0.20–0.25 |

in which the balance is essentially iron.

26 Claims, No Drawings

CORROSION RESISTANT AUSTENITIC ALLOY

This invention relates to corrosion resistant austenitic stainless steel and articles made therefrom and more particularly to such steel and articles made therefrom which are resistant to chloride crevice and pitting corrosion.

Alloys of chromium, nickel and iron containing varying amounts of molybdenum, manganese and nitrogen have hitherto been known which provide a good combination of mechanical and chemical properties. However, there has long been a particular need for an austenitic stainless steel alloy having good mechanical properties and capable of withstanding pitting and crevice corrosion in the presence of chloride ions. Hitherto, alloys provided for making articles used in chloride environments such as brackish water have left much to be desired or when capable of providing a required degree of corrosion resistance, particularly resistance to chloride pitting and crevice attack (such as is measured by exposure to ferric chloride, $FeCl_3$, at 50° C.) had been expensive to produce and/or difficult to fabricate into the required articles.

A. Bäumel, E. Horn and H. Grafen* point out the difficulties encountered in providing austenitic stainless steel articles requiring pitting and crevice corrosion resistance in aggresive media containing chlorine ions. They attribute such difficulties with Cr-Ni-Mo stainless steel containing in weight percent (w/o) nominally about 0.05 w/o Max. carbon, 17 w/o Cr, 13 w/o nickel, to the presence of delta-ferrite and point out that an addition of 0.15 w/o nitrogen to a composition containing 0.03 w/o carbon Max., 17 w/o Cr, 13 w/o Ni, 5 w/o Mo, the balance essentially iron provides a homogeneously austenitic structure. The authors also point out that stabilization of the austenitic balance by the nitrogen addition prevents delta-ferrite from decomposing into sigma phase during heat treatment or welding. While it is indicated that a ferrite free, homogeneous austenitic structure could also be obtained through an appropriate increase in the nickel-content, nitrogen is credited with retarding precipitation of intermetallic phases and carbides from the austenite. Bäumel U.S. Pat. No. 3,726,668, Apr. 10, 1973 relates to a welding filler material containing 0.001–0.2, preferably 0.001–0.1, w/o carbon, 0.1–5.0, preferably 0.1–2.0, w/o silicon, 0.25–10.0, preferably 0.25–5.0, w/o manganese, 15.0–25.0, preferably 15.0–20.0, w/o chromium, 3.5–6.0, preferably 3.5–5.0, w/o molybdenum, 8.0–30.0, preferably 10.0–16.0, w/o nickel, 0.01–3.0, preferably 0.01–1.5, w/o copper, 0.1–0.35, preferably 0.1–0.2, w/o nitrogen and the balance iron for use in providing austenitic surface weld layers or welded joints on predominantly austenitic substrate.

Proceedings of the Fifth International Congress on Metallic Corrosion (1974) pp. 934–941.

Deverell U.S. Pat. No. 4,007,038, Feb. 8, 1977, relates to Cr-Ni-Mo austenitic stainless steel containing 14–21 w/o Cr, 20–40 w/o Ni, 6–12 w/o Mo plus up to 0.2 w/o C, up to 2 w/o Mn, 0.006 w/o or less S, up to 1.00 w/o Nb, up to 0.5 w/o V, to which 0.005–0.05 w/o Ca and 0.010–0.20 w/o Ce or a maximum of 0.07 w/o Ce+Ca are added for the purpose of improving hot-workability as represented by the degree of edge checking.

Chivinsky et al, U.S. Pat. No. 4,099,966, July 11, 1978, discloses an austenitic stainless steel alloy described as being hot workable, as having superior pitting and corrosion resistance to the chloride ion and containing up to 0.1, preferably below 0.08, w/o carbon, 2.5–15, preferably 8–13.5, w/o manganese, up to 1, preferably below 0.75, w/o silicon, up to 0.01, preferably 0.007, w/o Max. sulfur, 19–23, preferably 9.5–22, w/o chromium, 5–16, preferably 9–13, w/o nickel, 3–5, preferably 3.5–4.5, w/o molybdenum, up to 1 w/o niobium, up to 0.3 w/o vanadium, up to 0.3 w/o titanium, nitrogen from 0.2 w/o to the limit of its solubility, preferably 0.23–0.33 w/o nitrogen, up to 0.1 w/o of cerium, calcium and magnesium combined up to 3 w/o copper and the balance iron.

The U.S. Pat. No. 4,007,038 and the U.S. Pat. No. 4,099,966 reinforce the views expressed by Bäumel, Horn and Grafen with regard to difficulties with Cr-Ni-Mo austenitic stainless steel alloys designed to resist chloride ion attack.

The present invention stems from the discovery that when the elements chromium, nickel and molybdenum are maintained within critically narrow limits, and the elements carbon, nitrogen and manganese are balanced in relation to each other and to the elements chromium, nickel and molybdenum, an austenitic stainless steel is provided characterized by outstanding resistance to chloride cervice and pitting corrosion. The alloy is suitable for a wide variety of uses depending upon how the elements, particularly manganese and nitrogen, are balanced within their stated ranges. For example, when the elements manganese and nitrogen are kept within their stated ranges but below sharply critical levels, the alloy provided is especially suited for autogenous welding and provides articles, for example welded tubing having outstanding resistance to chloride crevice and pitting corrosion. The combination of strength and corrosion resistance provided with the higher levels of nitrogen contemplated herein make the composition highly advantageous for use in such demanding areas as surgical implants or stranded cable for subsurface use in the ocean. The composition affords a desirable degree of flexibility in that its high strength makes it possible to decrease the amount of working or the amount of material required to attain a given strength level or load carrying capability.

It is, therefore, a principal object of this invention to provide a Cr-Ni-Mn-Mo-N austenitic stainless steel and products made therefrom having good resistance to chloride crevice and pitting corrosion which steel lends itself to production and working by conventional techniques.

Another object is to provide articles intended for use requiring exposure to chloride ions, particularly articles such as autogenously welded tubing exposed in use to brackish water, characterized by outstanding resistance to pitting and crevice corrosion.

The foregoing as well as additional objects and advantages are attained by carefully balancing the composition which consists essentially of the broad and preferred amounts in weight percent (w/o) of the elements indicated in Table I, the balance being iron. However, it is to be noted that the preferred minimum or maximum amount of one or more elements can be used with the broad maximum or minimum amounts respectively of the remaining elements to form intermediate ranges or to adjust the composition properties as will be more fully pointed out hereinbelow.

TABLE I

| | Broad (w/o) | Preferred (w/o) | Preferred For Autogenous Welding (w/o) |
|---|---|---|---|
| C | 0.03–0.1 | 0.03–0.08 | 0.06–0.08 |
| Mn | 4–11 | 4–7.5 | 4–6 |
| Cr | 20–23 | 20–23 | 20.5–21.5 |
| Ni | 14–18 | 14–18 | 14.5–15.5 |
| Mo | 4.8–5.6 | 4.8–5.4 | 4.8–5.4 |
| N | 0.15–0.6 | 0.20–0.5 | 0.20–0.25 |
| C + N | 0.23 Min. | 0.23 Min. | |
| B | 0.01 Max. | 0.005 Max. | 0.0015–0.0035 |

The balance of the composition is essentially iron which is intended to exclude all further additions in amounts which significantly alter the properties of the composition. For example, depending upon which deoxydizing practice is followed, small amounts of the elements used may be retained in the composition. Thus, when silicon is used as a deoxydizer some will be retained in the composition but should be limited, preferably to less than about 0.6 w/o, because silicon may adversely affect intergrannular corrosion resistance. Also, when present in too large an amount, silicon may result in the presence of unwanted sigma phase or ferrite. Aluminum may also be used as a deoxydizer but no more than 0.1 w/o, preferably no more than 0.07 or, better yet, no more than 0.05 w/o should be retained, because aluminum may tend to tie up nitrogen. Aluminum is also a strong ferrite former and in too large an amount may also objectionably detract from the hot workability of this composition. Misch metal, which is a mixture of rare earths made up primarily of cerium and lanthanum, can also be used for its scavenging properties and beneficial effect on hot workability. To that end, boron and misch metal can both be used. The beneficial effect of misch metal, when it is used, does not require that any definite amount of misch metal be retained in the composition and preferably there is little or none; its beneficial effect being provided during the melting process when, if used, up to about 0.4 w/o may be added.

Boron can be present in an amount up to about 0.005 w/o or even up to 0.01 w/o because of its beneficial effect on the forgeability of this composition. Because boron is believed to contribute to the corrosion resistance of the composition, preferably about 0.0015–0.0035 w/o is present.

Such elements as phosphorus and sulfur are kept low. Preferably phosphorus is limited to no more than 0.03 w/o and sulfur to no more than 0.005 w/o.

In this composition, the elements chromium, nickel and molybdenum are carefully balanced within the stated ranges in relation to each other and the elements carbon, manganese and nitrogen to provide a unique combination of mechanical and corrosion resistance properties, especially chloride crevice and pitting corrosion resistance. Of particular significance is that when the crevice corrosion resistance of the worked and annealed composition of the present invention is tested in accordance with ASTM G48-76, the weight loss measured after exposure to 6 w/o ferric chloride at 50 C. for 72 hours is less than 0.3 grams. To ensure the attainment of those properties, a minimum of about 20 w/o chromium, about 4.8 w/o molybdenum and about 14 w/o nickel are required. When chromium exceeds about 23 w/o, it contributes to the formation of second phases as also does molybdenum in amounts in excess of about 5.6 w/o, and the presence of second phases is to be avoided because of the adverse effect on corrosion resistance. Nickel works to ensure an austenitic structure in the alloy of this invention and its desired corrosion resistance. However, further additions of nickel above about 18 w/o, though tolerable, add to the cost of the alloy without correspondingly contributing to its usefulness. Best results are attained when the larger amounts of chromium and molybdenum are balanced with the larger amounts of nickel. Preferably about 20.5–21.5 w/o chromium and about 14.5–15.5 w/o nickel are used.

Carbon and, more importantly, nitrogen work together with nickel to ensure the austenitic balance of this composition and to minimize, preferably avoid entirely, the formation of phases which adversely affect the desired properties, particularly corrosion resistance. To that end, a minimum of about 0.03 w/o carbon and about 0.15 w/o nitrogen is required in this composition. Excessive carbon tends to adversely affect intergrannular corrosion resistance, probably because of the formation of harmful amounts of carbides or carbonitrides. For that reason, carbon is limited to no more than about 0.1 w/o, preferably to no more than about 0.08 w/o. On the other hand, nitrogen to the extent it can be retained in solution can be used in much larger proportions than carbon to maintain the austenitic structure of this composition and prevent the formation of unwanted phases. Thus, up to about 0.6 w/o nitrogen or more can be present.

Manganese works to increase the solubility of nitrogen in this composition and is added to ensure the retention of nitrogen in solution despite the fact that some of the nitrogen is required to offset the otherwise adverse effect of manganese on the corrosion properties of this composition. The adverse effect of manganese on corrosion resistance appears to be greater with the larger amounts of molybdenum contemplated herein with the result that more nitrogen is required to counterbalance a given amount of manganese when about 5.5 w/o molybdenum is present as compared to when about 5 w/o molybdenum is present.

With the other elements balanced as indicated in the broad range of Table I, when molybdenum is increased over its range from 4.8–5.6 w/o, relatively small changes in the molybdenum content have a substantial, adverse effect on chloride pitting and crevice corrosion resistance. That effect can be offset by an increase in the carbon plus nitrogen content of the composition. In view of the fact that no more than about 0.1 w/o carbon, preferably no more than about 0.08 w/o, is present, the amount of nitrogen present is increased together with the manganese as required to ensure that the nitrogen is retained in solution. In practice, it has been found that when the amounts of other elements present are substantially unchanged, and the amount of molybdenum present is increased by a few tenths of a percent, a useful guide in determining the corresponding minimum increase in the amount of nitrogen required to counter the adverse effect of the increase in molybdenum is about one tenth of the amount by which the molybdenum content has been increased. That is:

$$\text{Min. } \%\,(C + N) = .23 + \frac{(\%\ Mo - 4.8)}{10} \qquad \text{Eq. 1}$$

If it should prove to be necessary to increase the amount of manganese present in order to ensure retention of the increased amount of nitrogen in solution, then a somewhat larger increase, that is, several hundredths of a percent in the nitrogen content is preferred. The precision by which the amount of molybdenum and nitrogen present in this composition can be routinely determined varies about plus or minus 0.08% in the case of molybdenum and about plus or minus 0.01% to about 0.03% over the nitrogen range contemplated herein. However, when special pains are taken, that precision can be improved. In the case of the nitrogen determination, the analytical tolerance can be reduced to as little as plus or minus 0.005% at the low end of the nitrogen range and to as little as plus or minus 0.015% at the upper end. As a guide in adjusting the nitrogen content with molybdenum present in an amount equal to about 5.5 w/o it has been observed that with a manganese content of about 4 w/o, the carbon plus nitrogen content should preferably be at least about 0.3 w/o, with about 6 w/o manganese, the carbon plus nitrogen content should preferably be about 0.35 w/o, at about 8 w/o manganese, the carbon plus nitrogen content should be at least about 0.4 w/o, at about 9 w/o manganese, the carbon plus nitrogen should preferably be at least about 0.45 w/o, and at about 11 w/o manganese, carbon plus nitrogen should be at least about 0.5 w/o. That is:

$$\text{Min. \% (C + N)} = .23 + (\text{\% Mn} - 4) \times .03 \qquad \text{Eq. 2}$$

and combining Equations 1 and 2 gives:

$$\text{Min. \% (C + N)} = .23 + \frac{(\text{\% Mo} - 4.8)}{10}(\text{\% Mn} - 4) \times .03 \qquad \text{Eq. 3}$$

This composition is melted, cast and worked using well-known metallurgical techniques. Preferably, deoxydation of the heats is carried out using boron with aluminum and/or silicon. When forging is to be carried out, it is preferably done from a furnace temperature of about 2100 F. (1150–1200 C.). Annealing is preferably carried out at about 2150 F. (1175 C.).

The following examples of the present invention having the composition indicated in Table II were prepared as small, experimental heats and cast as ingots which were forged and hot rolled from a furnace temperature of 2100 F. (1150 C.), annealed in air at 2150 F. (1175 C.) for one half hour, cold rolled to 0.125 inch (0.32 cm) strip, annealed, and cut to form the required specimens for testing in accordance with ASTM G48-76.

TABLE II

| Ex. No. | C | Mn | Cr | Ni | Mo | N |
|---|---|---|---|---|---|---|
| 1 | .068 | 7.49 | 20.89 | 15.19 | 5.46 | .32 |
| 2 | .074 | 4.02 | 20.89 | 15.27 | 5.51 | .32 |
| 3 | .076 | 6.08 | 21.27 | 15.23 | 5.52 | .30 |
| 4 | .072 | 11.35 | 21.24 | 15.40 | 5.55 | .57 |
| 5 | .069 | 9.35 | 21.07 | 15.33 | 5.46 | .40 |
| 6 | .072 | 7.54 | 21.13 | 15.25 | 4.93 | .26 |
| 7 | .063 | 5.21 | 21.37 | 15.27 | 4.92 | .19 |
| 8 | .073 | 5.14 | 21.27 | 15.15 | 4.99 | .29 |
| 9 | .069 | 7.18 | 21.13 | 15.70 | 5.07 | .38 |
| 10 | .073 | 4.97 | 20.95 | 15.69 | 5.05 | .42 |
| 11 | .072 | 7.38 | 20.92 | 15.30 | 4.98 | .35 |
| 12 | .073 | 5.05 | 21.08 | 15.17 | 4.94 | .31 |
| 13 | .081 | 7.52 | 20.97 | 14.96 | 4.98 | .27 |
| 14 | .076 | 7.91 | 21.21 | 15.25 | 5.55 | .42 |

In each instance the balance was iron except for small amounts of but less than 0.6 w/o silicon, less than 0.03 w/o phosphorus, less than 0.005 w/o sulfur except Examples 1 and 4 contained 0.006 w/o sulfur, about 0.002–0.004 w/o boron except that Example 2 contained less than 0.0005 w/o boron, and each contained about 0.02–0.04 w/o cerium plus lanthanum except Example 4 which contained only 0.003 w/o and Example 7 which contained 0.055 Ce+La.

Unless otherwise indicated duplicate test specimens were prepared and tested in accordance with ASTM G48-76. Cold rolled specimens which had been annealed at 2150 F. (1176 C.) for 12 minutes and then air cooled (CRA) were subjected to the crevice test in 10 w/o $FeCl_3.6H_2O$ at 50° C. for 72 hours. The specimens were weighed prior to and after exposure to the test environment to determine the weight loss in grams. A chloride pitting corrosion test without a crevice was also carried out in accordance with ASTM G48-76 on three sets of specimens. One set was made up of welded specimens which had not been annealed and two sets were welded and annealed with two different annealing treatments. The welded specimens were first cold rolled and annealed and then gas tungsten arc welded. One third of the welded specimens was not annealed, another third was annealed for 35 seconds at 2150 F. in molten salt and then quenched in water (W+Ann, WQ) and the final third was annealed at 2150 F. for 12 minutes and then cooled in air (W+Ann, AC). The weight loss suffered by each specimen in grams is set forth in Table III.

TABLE III (Weight Loss in Grams)

| Ex. No. | Crevice Test CRA | Pitting Test Welded | W + Ann, WQ | W + Ann, AC |
|---|---|---|---|---|
| 1 | .2390 | .8122 | .0004 | .0869 |
| | .1712 | .8802 | — | .0918 |
| 2 | .0125 | .5127 | 0 | 0 |
| | .1614 | .9046 | 0 | 0 |
| 3 | .1975 | .8135 | .0002 | .0009 |
| | .1045 | .9048 | 0 | .0008 |
| 4 | .0003 | .0001 | .0002 | .0002 |
| | 0 | .0701 | .0002 | 0 |
| 5 | .2357 | 1.2024 | .0016 | .0135 |
| | .2622 | 1.2809 | .0002 | .0016 |
| 6 | .1641 | .7064 | .0617 | 0 |
| | .2254 | .8009 | .0016 | 0 |
| 7 | .2179 | .6221 | .0005 | 1.0276 |
| | .2547 | 1.1222 | .5020 | .3647 |
| 8 | .0166 | .3180 | .0007 | 0 |
| | .0090 | .0946 | .0002 | 0 |
| 9 | .0031 | .0005 | .0008 | .0044 |
| | .0030 | 0 | .0027 | 0 |
| 10 | .0012 | 0 | .0006 | 0 |
| | .0091 | 0 | .0005 | 0 |
| 11 | .1197 | .0899 | .0010 | .0016 |
| | .0954 | .0004 | .0234 | .0024 |
| 12 | .0013 | .0400 | .0959 | .0003 |
| | .0122 | .1645 | .0009 | .0005 |
| 13 | .1482 | .0009 | — | — |
| | .0145 | .0008 | — | — |
| 14 | .0071 | — | — | — |
| | .0003 | — | — | — |

Specimens of Examples 1–14 in the cold rolled annealed condition (CRA) showed no harmful effect of sigma phase. In the case of the as welded specimens, sigma phase was found in all specimens except for the specimens of Examples 4, 9 and 10. The welded and annealed specimens of Examples 1–6 and 8–13 were free of the harmful effects of sigma. Example 7 demonstrates the less than preferred chloride corrosion resistance with the relatively low nitrogen content of 0.19 w/o. Longer annealing time, e.g. up to about one-half hour, followed by quenching in water should be used when better welded plus annealed corrosion properties are wanted.

The following heats having the composition indicated in Table IV were prepared as was described in connection with Examples 1–14.

TABLE IV

| Heat | C | Mn | Cr | Ni | Mo | B | N | Ce + La |
|---|---|---|---|---|---|---|---|---|
| A | .076 | 7.38 | 21.20 | 15.03 | 5.45 | .0031 | .25 | .022 |
| B | .072 | 11.26 | 21.45 | 15.38 | 5.49 | .0031 | .35 | .019 |
| C | .072 | 7.37 | 20.96 | 15.06 | 4.99 | .0025 | .17 | .053 |
| D | .071 | 7.37 | 17.37 | 15.34 | 5.45 | .0032 | .33 | .021 |
| E | .066 | 7.49 | 19.49 | 15.27 | 5.46 | .0033 | .35 | .024 |
| F | .073 | 7.58 | 21.25 | 15.23 | 4.50 | .0030 | .34 | .020 |
| G | .065 | 7.48 | 20.94 | 15.21 | 6.49 | .0029 | .37 | .028 |

As in the case of Examples 1–14, the balance of each heat was iron except for less than about 0.6 w/o silicon, less than 0.03 w/o phosphorus, and less than 0.005 w/o sulfur.

Duplicate test specimens of each of Heats A-G were prepared as described in connection with Examples 1–14 and tested in accordance with ASTM G48-76. The results of the crevice corrosion and pitting tests are set forth in Table V.

TABLE V

| | | (Weight Loss in Grams) | | |
|---|---|---|---|---|
| | Crevice | Pitting Test | | |
| Heat | CRA | Welded | W + Ann, WQ | W + Ann, AC |
| A | .6037 | 1.4061 | .0398 | 1.0530 |
| | .5877 | 1.1940 | .0005 | 1.2325 |
| B | 1.0880 | 1.3173 | 0 | .8091 |
| | 1.0791 | 1.2085 | .3551 | .6750 |
| C | .2400 | .8961 | .5067 | 1.3551 |
| | .2826 | .9871 | .2009 | 1.2256 |
| D | .9959 | .9956 | 1.0107 | .4869 |
| | 1.0361 | 1.0362 | 1.1444 | .5152 |
| E | .5293 | .6068 | .1115 | .0007 |
| | .3442 | .6588 | .3312 | .0003 |
| F | .4230 | .0770 | .0078 | .0105 |
| | .4114 | .5880 | .1685 | .0387 |
| G | 1.2708 | .0008 | .0002 | .3511 |
| | 1.3449 | .5030 | .3386 | .5118 |

Most, if not all, of the test material was examined with the optical microscope to confirm the presence of sigma phase in the cold rolled specimens that showed excess weight loss in the crevice corrosion test. Specimens of Heats A and B cold rolled annealed (CRA) were also examined with the scanning electron microscope. Both the cold rolled annealed and welded specimens of Heats A and B showed sigma phase. Heat A demonstrates the criticality of increasing the nitrogen content sufficiently when the manganese content is 7.38 w/o as compared to Example 3 with 6.08 w/o manganese. When 7.49 w/o manganese is balanced with 0.32 nitrogen (0.338 w/o C+N) as in Example 1 chloride crevice corrosion resistance is improved. The poor chloride corrosion resistance of Heat B is to be contrasted with the outstanding corrosion resistance of Example 4 where 11.35 w/o manganese was balanced with 0.57 w/o nitrogen (0.642 w/o C+N). Heat C demonstrates that even with molybdenum reduced to 4.99 w/o, 0.17 w/o nitrogen (0.242 w/o C+N) is not enough to balance 7.37 w/o manganese and provide good chloride pitting corrosion resistance in the as welded and annealed condition. Heats D and E are believed to demonstrate the adverse effect when chromium is too low and Heats F and G demonstrate respectively the effect on chloride crevice corrosion resistance when the composition contains too little or too much molybdenum.

In accordance with another embodiment of this invention, the elements C, Mn, Cr, Ni, Mo, N and B are balanced as indicated in the right-hand column of Table I to provide an alloy which not only has a high degree of resistance to chloride crevice and pitting corrosion resistance, but which is particularly suited for autogenous welding to provide welded products characterized by outstanding resistance to chloride crevice and pitting corrosion. The following example is illustrative of this embodiment.

EXAMPLE 15

As a further example of this composition, a heat was melted and cast into ingots containing:

| | w/o |
|---|---|
| Carbon | 0.07 |
| Manganese | 5.36 |
| Silicon | 0.28 |
| Phosphorus | 0.021 |
| Sulfur | 0.007 |
| Chromium | 20.41 |
| Nickel | 15.39 |
| Molybdenum | 5.06 |
| Nitrogen | 0.25 |
| Boron | 0.0038 |

The balance was iron and incidental amounts of other elements. Forging and hot rolling to 0.220 in (0.56 cm) strip were carried out from a temperature of 2150°–2200° F. (1175°–1200° C.). The thus formed strip was annealed, cleaned and then cold rolled to 0.028 in (0.071 cm) strip. The cold-rolled strip was annealed and formed into test specimens in accordance with the specifications of the appropriate ASTM test. When tested in that condition, the 0.2 percent yield strength was 56,000 psi (386.1 MPa), the tensile strength was 113,000 psi (779.1 MPa), the elongation in 2 inches (5.08 cm) was 45.0 percent. The hardness in that condition was Rockwell B85.

Duplicate chloride corrosion test specimens were prepared as described and then tested in accordance with ASTM G48-76 in $FeCl_3$ at 50° C. for 72 hours. In addition to flat specimens, lengths of tubing formed by autogenously welding and annealing previously described strip were also tested. The duplicate welded and annealed specimens, when tested for pitting, one had no weight loss and the other had a weight loss of 0.0022 gram. In the case of duplicate flat specimens tested with crevices, one had a weight loss of 0.1154 g, and the other a weight loss of 0.0476 g. When for purposes of comparison, an alloy of the U.S. Pat. No. 4,007,038 (containing 0.025 w/o C, 1.6 w/o Mn, 20 w/o Cr, 24.5 w/o Ni, 6.4 w/o Mo, 0.032 w/o N, 0.0012 w/o B and balance iron) was subjected to the same test for crevice corrosion, one duplicate specimen had a weight loss of 0.4240 g, and the other had a weight loss of 0.9098 g.

For further comparison with Example 15, Heat H was prepared as described in connection with Example 15 having the following composition, the balance being iron:

| Heat | C | Mn | Si | P | S | Cr | Ni | Mo | N | B |
|---|---|---|---|---|---|---|---|---|---|---|
| H | .07 | 5.37 | .27 | .022 | .006 | 20.52 | 15.38 | 5.02 | .27 | .0027 |

The only significant difference between Example 15 and Heat H is believed to be the larger average nitrogen content of 0.27. When coils of the alloy of Example 15 and of Heat H were autogenously welded into 1⅛ inch (2.86 cm) OD tubing having a wall thickness of 0.028 in (0.071 cm) problems were encountered with the material formed from Heat H that did not occur with the Example 15 tubing. During the welding of the Heat H coil, the arc was unstable, there was considerable sparking and what was considered excessive electrode erosion. This resulted from the small but significant increase in nitrogen content. The Example 15 material was autogenously welded under the same conditions without experiencing those or any other significant difficulties. The mechanical properties of Heat H as measured by room temperature tensile tests did not differ significantly from the properties of the composition of Example 15. The 0.2 percent yield strength of the specimens formed from Heat H was 58,000 psi (399.9 MPa), the tensile strength was 114,000 psi (786 MPa), and the elongation in 2 inches (5.08 cm) was 41 percent.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. A corrosion resistant austenitic stainless steel alloy consisting essentially in weight percent of about

| | (w/o) |
|---|---|
| C | 0.03–0.1 |
| Mn | 4–11 |
| Si | 0.6 Max. |
| Cr | 20–23 |
| Ni | 14–18 |
| Mo | 5.05–5.6 |
| B | 0.01 Max. |
| Ce + La | 0.4 Max. |
| Al | 0.1 Max. |
| [C + N | 0.23 Min.] |

in which nitrogen ranges from a minimum of 0.15 w/o to no more than the amount that can be retained in solid solution, the minimum amount of carbon plus nitrogen being equal to:

$$.23 + \frac{(\%\ Mo - 4.8)}{10} + (\%\ Mn - 4) \times .03$$

the balance being essentially iron, and the elements being balanced so that cold rolled annealed specimens prepared with a crevice and tested in accordance with ASTM G48-76 in 10 w/o $FeCl_3.6H_2O$ at 50 C. for 72 hours have a weight loss of less than 0.3 gram.

2. The alloy set forth in claim 1 containing no more than about 5.4 w/o molybdenum.

3. The alloy set forth in claim 1 containing no more than about 7.5 w/o manganese.

4. The alloy set forth in claims 1, 2 or 3 containing no more than 0.6 w/o nitrogen.

5. The alloy set forth in claims 1, 2 or 3 containing at least 0.20 w/o nitrogen.

6. The alloy set forth in claim 5 containing no more than 0.5 w/o nitrogen.

7. The alloy set forth in claim 5 containing no more than 0.08 w/o carbon.

8. The alloy set forth in claim 7 containing no more than 0.07 w/o aluminum, and no more than 0.005 w/o boron.

9. The alloy set forth in claim 7 containing no more than 0.05 w/o aluminum, and 0.0015–0.0035 w/o boron.

10. The alloy set forth in claim 7 containing at least 0.06 w/o carbon.

11. The alloy set forth in claim 10 containing no more than 0.03 w/o phosphorus and no more than 0.005 w/o sulfur.

12. The alloy set forth in claim 11 containing no more than 0.07 w/o aluminum.

13. The alloy set forth in claim 11 containing no more than 0.05 w/o aluminum.

14. The alloy set forth in claim 2 containing 0.06–0.08 w/o carbon.

15. The alloy set forth in claim 14 containing 4–6 w/o manganese and 0.20–0.25 w/o nitrogen.

16. The alloy set forth in claim 15 containing 20.5–21.5 w/o chromium, and 14.5–15.5 w/o nickel.

17. The alloy set forth in claim 16 containing no more than about 0.005 w/o boron.

18. The alloy set forth in claim 16 containing 0.0015–0.0035 w/o boron.

19. A corrosion resistant austenitic article which consists essentially in weight percent of about:

| | (w/o) |
|---|---|
| C | 0.03–0.1 |
| Mn | 4–11 |
| Si | 0.6 Max. |
| Cr | 20–23 |
| Ni | 14–18 |
| Mo | 5.05–5.6 |
| B | 0.01 Max. |
| Ce + La | 0.4 Max. |
| Al | 0.1 Max. |
| [C + N | 0.23 Min.] |

in which nitrogen ranges from a minimum of 0.15 w/o to no more than the amount that can be retained in solid solution, the minimum amount of carbon plus nitrogen being equal to:

$$.23 + \frac{(\%\ Mo - 4.8)}{10} + (\%\ Mn - 4) \times .03$$

the balance being essentially iron, and in which the elements are balanced so that cold rolled annealed specimens thereof prepared with a crevice and tested in accordance with ASTM G48-76 in 10 w/o $FeCl_3.6H_2O$ at 50° C. for 72 hours have a weight loss of less tha 0.3 gram.

20. The article set forth in claim 19 containing no more than 5.4 w/o molybdenum.

21. The article set forth in claim 19 containing no more than 7.5 w/o manganese.

22. The article set forth in claim 19 containing no more than 5.4 w/o molybdenum, no more than 7.5 w/o manganese, and at least 0.20 w/o nitrogen.

23. The article set forth in claim 22 containing no more than 0.08 w/o carbon.

24. The article set forth in claim 23 containing at least 0.06 w/o carbon.

25. The article set forth in claim 24 containing 4–6 w/o manganese.

26. The article set forth in claim 25 which includes at least one autogenous weld and which contains 20.5–21.5 w/o chromium, 14.5–15.5 w/o nickel, no more than 0.25 w/o nitrogen, and 0.0015–0.0035 w/o boron.

* * * * *

UNITED STATES PATENT AND TRADEMARK OFFICE

CERTIFICATE OF CORRECTION

PATENT NO. : 4,371,394

DATED : February 1, 1983

INVENTOR(S) : Michael Henthorne, Robert J. Yinger & Terry A. DeBold

It is certified that error appears in the above—identified patent and that said Letters Patent is hereby corrected as shown below:

Facing Page, Item 75, after "Michael Henthorne", for "Los Altos" read -- Houston, Texas --.

Col. 1, between lines 55 and 56, before "Proceedings" insert -- * --.

Col. 2, line 4, for "9.5-22" read -- 19.5-22 --;

line 26, for "cervice" read -- crevice --.

Col. 5, line 40, for "2100 F" read -- 2100-2200 F --.

Col. 10, line 60, for "tha" read -- than --.

Signed and Sealed this

Fourteenth Day of February 1984

[SEAL]

Attest:

GERALD J. MOSSINGHOFF

Attesting Officer

Commissioner of Patents and Trademarks